United States Patent [19]

Cappotto et al.

[11] 4,005,771

[45] Feb. 1, 1977

[54] SPEED RETARDING GOVERNOR

[75] Inventors: Samuel D. Cappotto, Syracuse; John E. Dodge, Cortland, both of N.Y.

[73] Assignee: SCM Corporation, New York, N.Y.

[22] Filed: Nov. 10, 1975

[21] Appl. No.: 630,469

[52] U.S. Cl. ..... 197/64; 188/185; 197/183

[51] Int. Cl.[2] ..... B41J 19/02

[58] Field of Search ..... 188/184, 185; 197/64, 197/176–179, 183

[56] References Cited

UNITED STATES PATENTS

| | | | |
|---|---|---|---|
| 2,270,460 | 1/1942 | Mehan | 188/185 |
| 2,758,692 | 8/1956 | Barkdoll | 197/64 |
| 2,784,829 | 3/1957 | Kupper | 197/64 |
| 2,829,754 | 4/1958 | Norcross | 188/184 X |
| 3,645,363 | 2/1972 | Fuths | 197/64 X |

FOREIGN PATENTS OR APPLICATIONS

| | | | |
|---|---|---|---|
| 166,442 | 7/1921 | United Kingdom | 197/164 |

*Primary Examiner*—Robert E. Bagwill
*Assistant Examiner*—Paul T. Sewell
*Attorney, Agent, or Firm*—Stanley J. Klem; E. W. Weinberger; M. M. Wolson

[57] ABSTRACT

A speed retarding governor particularly adaptable to a carriage of a typewriter wherein the speed of a traversing typewriter carriage is retarded by the cooperation of a plurality of arcuate pivotless lightweight flyweights that are floatably disposed within a cylindrical governor housing. A drive pin fixed to a rotating typewriter escapement toothed drive wheel engages an end of a first flyweight which abuts a second flyweight whereby both flyweights rotate therewith. The centrifugal force thus generated forces the two felt-lined flyweights outwardly against the internal peripheral surface of the governor housing which has now been rendered stationary, to produce a retarding force necessary to retard the speed of the traversing carriage.

34 Claims, 8 Drawing Figures

SPEED RETARDING GOVERNOR

BACKGROUND OF THE INVENTION

The present invention relates to speed retarding governors and in particular to a speed retarding centrifugal governor for traversing typewriter carriages. Carriage retarding governors as disclosed in the prior art include a plurality of pivotally supported heavy flyweights that are coupled to a traversing carriage and respond to the carriage speed thereto. The flyweights are pivotally supported on a rotatable spring drum that is coupled to the carriage by a cord. As the carriage traverses under the urge of the power supplied by the spring drum disc, the spring drum disc rotates. The flyweights, being attached to the spring drum disc are also urged to rotate and the centrifugal force on the flyweights coupled with the mass causes the flyweights to pivot outward where they frictionally contact the inner peripheral surface of the stationary spring drum housing, thereby retarding the speed of the traversing carriage. To prolong the life of the flyweights, replaceable pads are inserted on the outer periphery of the flyweights. These pads contact the inner surface of the spring drum housing when the flyweights are subjected to the effect of centrifugal force. For example, U.S. Pat. No. 2,829,754 granted to J. H. Norcross on Apr. 8, 1958 discloses a pair of flyweights pivotally supported on a rotatable disc within a spring drum housing. The outermost surface of the flyweights have a nylon pad inserted therein. As the carriage traverses, a gear on the spring drum that powers the carriage traverses, engages a pinion on the governor, which in turn engages a spring clutch that couples the power from the rotating pinion to the shaft on which the flyweights are attached. The flyweights pivot outward about their pivot and the nylon inserts contact the inner peripheral surface of the housing to effect a reduction in the speed of the carriage as the carriage traverses. Therefore, the effectiveness of the governor is entirely dependent on the ability of the fly-weights to freely pivot within the spring drum housing and to contact the internal peripheral surface evenly.

Since the prior art flywights are physically confined to pivot about an axis, the outward movement thereof describes an arc about the pivot and therefore only one restricted portion of the flyweights will contact the housing whereby the prior art braking contact surface is limited. In the event there is any binding about the flyweight pivots and the flyweights cannot freely pivot, the governor becomes ineffective or its effectiveness is severely restricted.

In contrast, the present inventive concept teaches a pair of non-pivotal flyweight segments that are floatably disposed within a housing to provide a more uniform contact between the segments and the housing which results in a more efficient governor. Another example of a governor that utilizes centrifugal flyweights is U.S. Pat. No. 3,645,363 granted to G. Fuths on Feb. 29, 1972. U.S. Pat. No. 3,645,363 discloses a pair of flyweights that are pivotally supported on a camming plate within a brake housing to regulate the speed of a shaft and pinion that engages a carriage rack.

The pivots are supported on the camming plate and adjustably disposed within the brake housing. Therefore, adjustment of the camming plate varies the radial distance from the axis of the shaft to the pivot axis. The closer the pivots are to the center of the shaft axis, the greater the force that is exerted by the flyweights against the inner peripheral surface of the brake housing when the carriage is traversing. Consequently, the braking effect on the traversing carriage is increased. The more distant the pivots are from the center of the shaft axis, the less the force that is exerted by the flyweights against the inner peripheral surface of the brake housing when the carriage is traversing. Consequently, the braking effect on the traversing carriage is decreased. The effectiveness of this speed regulating mechanism is also entirely dependent on the ability of the flyweights to freely pivot within the brake housing and to contact the peripheral surface evenly. Any binding about the pivots will prevent proper pivoting of the flyweights and the effectiveness of the speed regulating mechanism will be adversely effected. Furthermore, since the surface contact of the flyweights is only over a limited area, any uneven contact with the inner peripheral surface of the brake housing will result in erratic braking.

The present invention does not depend on the flyweight pivoting about a fixed support axis, for there is no support axis nor any pivotal motion. The flyweights float within the housing and are therefore self centering and self seating. In other words, the inherent freedom of movement of the floating flyweights allows the entire outer peripheral braking surface of the flyweights to contact the inner peripheral surface of the housing evenly. A drive pin that is fixed to a rotatable carriage coupled drive plate; engages one end of one flyweight to rotate that flyweight radially within the housing to abut the end of the second flyweight. Both flyweights begin to spin and the resulting centrifugal force thrusts and wedges the flyweights against the then stationary housing resulting in a speed limiting drag on the carriage during traverse.

The carriage speed retarding governors of the prior art include flyweights that are pivotally supported on a rotatable drive plate. The speed retarding governors of the prior art further include flyweights that must be freely pivotal in order for them to be fully affected by centrifugal forces when they are rotating. The effectiveness and efficiency of governors employing flyweights having fixed pivots depends on the extremely small frictional forces or bearings at the pivot. Use of bearings increases cost, as does machining to insure low friction. The foregoing undesirable structure is overcome by the elimination of any fixed pivot in the present invention. Furthermore, the mass of the flyweights must be great enough to aid in the braking effect of the flyweights. The present invention does not include pivotal flyweights but floating flyweights. In other words, the flyweights are freely positionable within the governor housing and only restricted in their orientation by their proximity to one another. For example, the flyweights, being substantially semi-circular in contour and each occupying an area of the interior of the circular governor housing are not restricted in their movement other than by the peripheral confines of the housing itself and are free to function within the housing without binding. Furthermore, a fixed member of the rotatable drive plate abuts an end of one of the flyweights to render the governor operational. If some restriction occurs within the governor housing to adversely limit the movement of the flyweights, the fixed member on the drive plate would abut that one flyweight and consequently the second flyweight would respond to the movement of the first flyweight and render both flyweights operational. In addition, the flyweight segments being floatable, are self centering by virtue of their contour and self seating by virtue of their freely positionable floatable structure. In other words, the outer peripheral arcuate braking surface of the flyweight segments will contact the inner peripheral arcuate surface of the governor housing evenly.

In governors employing pivotal flyweights where the effectiveness of the governor depends entirely on the unrestricted pivoting of the flyweights, any binding of the flyweights or bearings would cause the governor to malfunction and require extensive and costly repair or replacement. Moreover, the effective operation of the governor is dependent on its rotational velocity that is predicated by the movement of the traversing carriage. For example, the pivotal movement of the flyweights occurs only when the centrifugal forces generated by the rotating governor are sufficient to urge the flyweights outward of the governor's axis. The fly-weight will therefore remain dormant during the first moments of carriage traverse. As the carriage movement increases, the rotational velocity of the governor also increases to generate gradually increasing centrifugal forces which act upon the flyweights, causing pivotal movement thereof to render the governor operational.

The freely positionable floatable structure in cooperation with the abutting rotating drive member of the present invention overcomes the potential problem of binding. Although the effective operation of the governor of the present invention is still dependent on its rotational velocity, the velocity necessary to render the governor operational is less than the velocity required in the prior art governors and therefore more efficient.

The floatable structure of the flyweights also allows for the use of flyweights having less mass than the prior art. This is possible because the entire mass of the flyweights is in functional engagement with the governor housing, whereas only a portion of the prior art flyweights, that portion beyond the pivots, is in a functional engagement.

SUMMARY OF THE INVENTION

In the illustrated embodiments of the present invention, there is shown a carriage speed retarding governor for typewriter carriage traversing during tabulation. The general purpose of this invention is to provide a carriage speed governor for typewriters that has all the advantages of similarly employed prior art devices and none of the above-described disadvantages. To attain this purpose, the present invention provides a carriage speed retarding governor that includes a cylindrical open ended governor housing rotatably and co-axially supported on a typewriter escapement drive wheel. The governor housing provides enclosure for a pair of arcuate flyweight segments. The flyweight segments are floatably positioned within the governor housing and are self positioning relative to the internal periphery of the governor housing when they begin to rotate. Projecting from the surface of the escapement drive wheel is a drive pin which is disposed between the ends of the flyweight segments when the segments are positioned within the governor housing and provides the initial driving force to effect movement of the segments. The other ends of the flyweight segments define abutting apex portions theron, hereafter referred to as load transfer projections. The term "load transfer projections" is used in this disclosure to more accurately define the function of the apex portions in that the driving force effect of the drive pin on one flyweight segment is transferred to the second flyweight segment via the apex portions. The proximity of the load transfer projections to the drive pin during rotation of the flyweight segments determines the effectiveness of the governor. In other words, the braking effect of the flyweights is amplified if the load transfer projections are disposed nearer the drive pin. Conversely, the braking effect of the flyweights is decreased if the load transfer projections are disposed farther from the drive pin. The initial driving force on the segments by the rotating drive pin causes one end of the first flyweight segment to pivot outward about the load transfer projection to wedge against the stationary governor housing. Thereafter, the second flyweight segment is wedged against the stationary housing whereupon the rotating velocity of the flyweights has increased enough to impart centrifugal force on the flyweights for uniform braking.

When the load transfer projections are disposed nearer the drive pin the wedging effect on the flyweight segments is increased and the initial braking response time is decreased. When the load transfer projections are disposed more distant from the drive pin, the wedging effect on the flyweight segments is decreased and the initial braking response time is increased.

During tabulation, the typewriter escapement rocker is rocked and latched downward at which time a portion thereof engages one of the teeth projecting from the wall of the governor housing to prevent its rotation. The speed retarding device is therefore operational in that the escapement drive wheel rotates as the carriage traverses and the drive pin, being fixed on the escapement wheel, also rotates. The drive pin abuts the end of one flyweight segment which is forced into abutment with the second flyweight segment. Therefore, both flyweight segments rotate and are centrifugally forced against the internal periphery of the stationary governor housing to effect a speed retarding drag on the typewriter carriage.

In order to reduce the wear on the brake housing and flyweight segments and to effect a more uniform and relatively noiseless speed regulation, a first embodiment of the present invention includes a felt liner disposed along the braking periphery of each flyweight segment. A second embodiment includes a plurality of spaced felt inserts disposed on the braking periphery near the ends of the flyweight segments.

Accordingly, an object of the present invention is to provide a typewriter governor that employs pivotless flyweights.

Another object of the present invention is to provide a typewriter governor that is lightweight, compact, and inexpensive.

A further object of the present invention is to provide a typewriter governor that is of simple and miniaturized construction.

A still further object of the present invention is the provide a typewriter governor that requires minimum maintenance.

A still further object of the present invention is to provide a typewriter governor that does not require expensive precision machining.

A still further object of the present invention is to provide a typewriter governor that requires no critical adjustments.

A still further object of the present invention is to provide a typewriter governor whereby the braking segments require less mass and still impart the same or more braking effect on the traversing typewriter carriage than the typewriter governors now in use.

A still further object of the present invention is to provide a typewriter governor that functions with a minimum of noise.

A still further object of the present invention is to provide a typewriter governor with a rapid braking response time.

A still further object of the present invention is to provide a typewriter governor with uniform braking.

Other objects, features, and advantages of the invention will become more apparent from the following description, appended claims, and accompanying drawings.

DESCRIPTION OF THE PREFERRED EMBODIMENT

Figure 1:
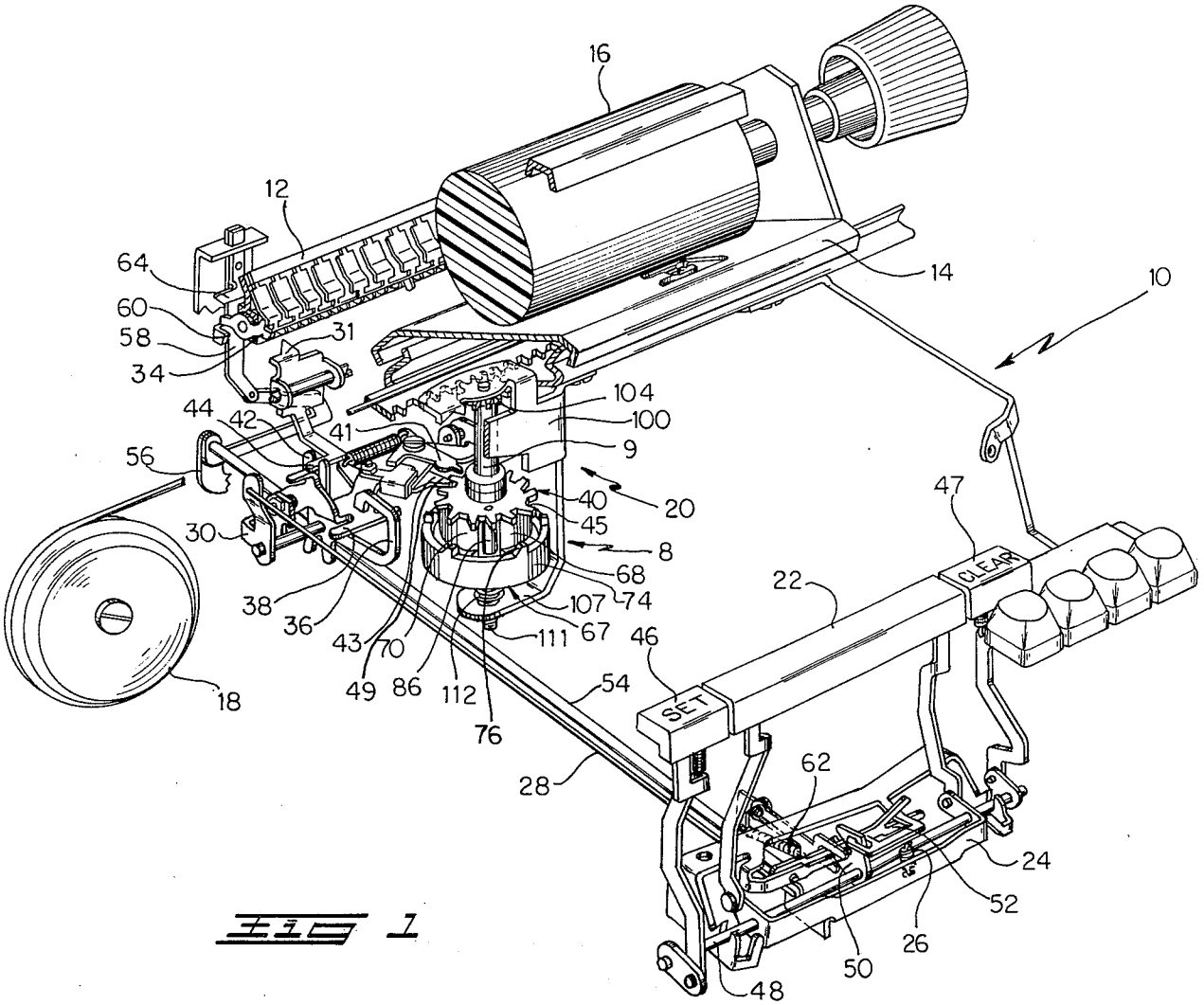
FIG. 1 is a perspective view of a portion of a typewriter showing the invention therein.

As illustrated in FIG. 1, the carriage speed retarding governor 8 of the present invention is co-axially supported on a rotatable escapement shaft 9 within a typewriter 10. The typewriter 10 includes an upstanding tabulation rack 12 supported transverse the typewriter and a traversable carriage 14 that provides support for a printing platen 16. The carriage 14 is driven by a spring drum 18 and incrementally regulated in its traverse by an escapement mechanism 20 of the type that is fully disclosed in U.S. Pat. No. 2,649,179 entitled CARRIAGE FEEDING ESCAPEMENT MECHANISM granted on Aug. 18, 1953 and having the same Assignee as the instant application.

In order to more fully understand the novelty of the instant invention and its importance in relation to a typewriter during tabulation operation, the structure and operation of the tabulating mechanism of the typewriter 10 will be described.

A tabulating mechanism for typewriter 10 includes three separately actuable but cooperating mechanisms; a tabulating mechanism, a tabulating set mechanism, and a tabulating clear mechanism.

Figure 3:
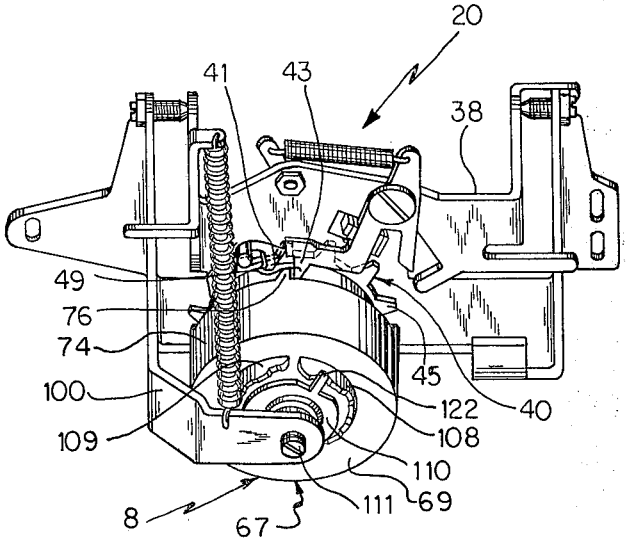
FIG. 3 is the view of FIG. 2 with the escapement mechanism oriented for governor operation.

The tabulating mechanism includes a tabulator bar 22, that is coupled to a tabulator rocker 24, and maintained in its rest position by a return spring 26. A draw link 28 connects rocker 24 to a tabulator bellcrank 30. Tabulator bell crank 30 urges a tab dog 31 from an effective to an ineffective position in relation to a plurality of tabulator stops 34 that are pivotally supported along tabulator rack 12. During operation, depression of tabulator bar 22 rotates tabulator rocker 24 which overcomes the biasing effect of spring 26 and pulls draw link 28 forward. Draw link 28, being connected to tabulator bellcrank 30, urges bellcrank 30 to pivot clockwise as viewed in FIG. 1. An arm 36 of bellcrank 30 abuts an escapement rocker 38 of escapement mechanism 20 and urges escapement rocker 38 to pivot clockwise, thereby disengaging a pair of escapement rocker supported escapement dogs 41 and 43 from an escapement wheel 40 as shown in FIG. 3. Simultaneously, an integral upstanding fork 42 of bellcrank 30 that engages an extension 44 of tabulator dog 31 urges tabulator dog 31 to rotate counter-clockwise into the path of pre-set tabulator stop 34. At this time, because of the disengagement of escapement dogs 41 and 43, escapement wheel 40 is freee to rotate. The carriage 14, under the urge of spring drum 18, will then traverse at an uncontrolled acceleration to the left until present tabulator stop 34 contacts extended tabulator dog 31.

If carriage 14 is allowed to traverse uncontrolled to the position of tabulator dog 31, pre-set tabulator stop 34 will impact on tabulator dog 31 with a force that will jar the typewriter or possibly damage tabulation rack 12. The greater the distance from the location of tabulator dog 31 to the location of tabulator stop 34 at the time tabulator bar 22 is depressed, the greater the possibility of component damage. It is therefore necessary to employ a mechanism, such as the instant invention, to retard or limit the speed of the traversing carriage thereby preventing damage to tabulator associated components and effecting a smoother typewriter operation.

The setting and clearing of tabulator stops 34 is controlled by a setting and clearing mechanism. Depression of a tabulator set bar 46 causes an actuator shaft 48 to rotate clockwise which in turn, raises an actuator shaft fork 50 which raises a front arm 52. As front arm 52 is raised, a motion transmitting shaft 54 is rotated counterclockwise to transmit upward motion to a rear arm 56 and a tabulator set slide 58. As tabulator set slide 58 moves upward, an integral projecting lug 60 of set slide 58 contacts tabulator stop 34 thereby actuating it to a tab set position. A return spring 62 urges the tabulator set mechanism to its rest position after tabulator stop 34 is set and a tabulator set bar 46 is released. The tabulator clearing mechanism is actuated by pressing a tabulator clear bar 47. Tabulator clear bar 47 is coupled to the same mechanism as tabulator set bar 46, but the motion transmitted by the mechanism is reversed. For example, actuator shaft 48 is rotated counterclockwise, actuator fork 50 is lowered, motion transmitting shaft 54 is rotated clockwise, and tabulator set slide 58 is moved downward. As tabulator set slide 58 is moved downward, a projecting clear cam 64, supported thereon, contacts pre-set tabulator 34 to return it to its clear position in tabulator rack 12.

Figure 6:
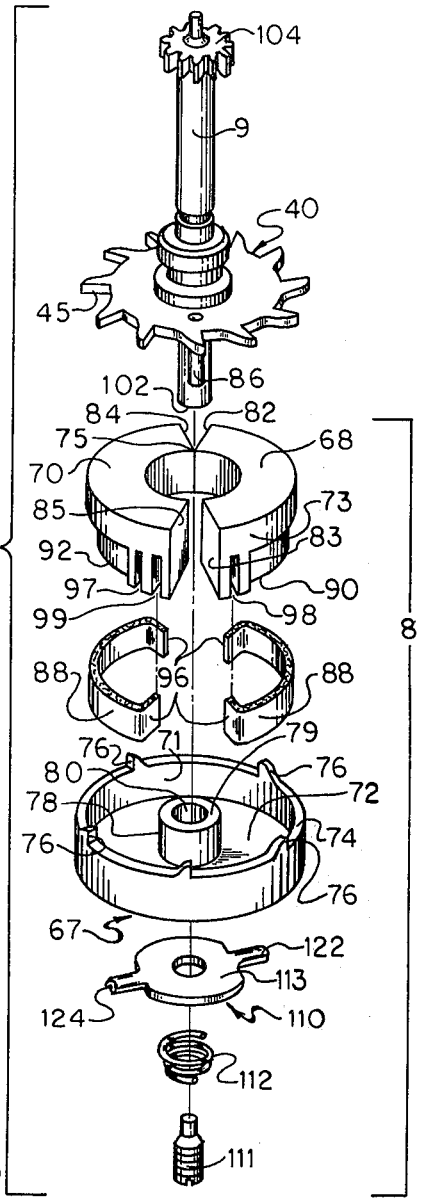
FIG. 6 is an exploded view of the present invention.
Figure 7:
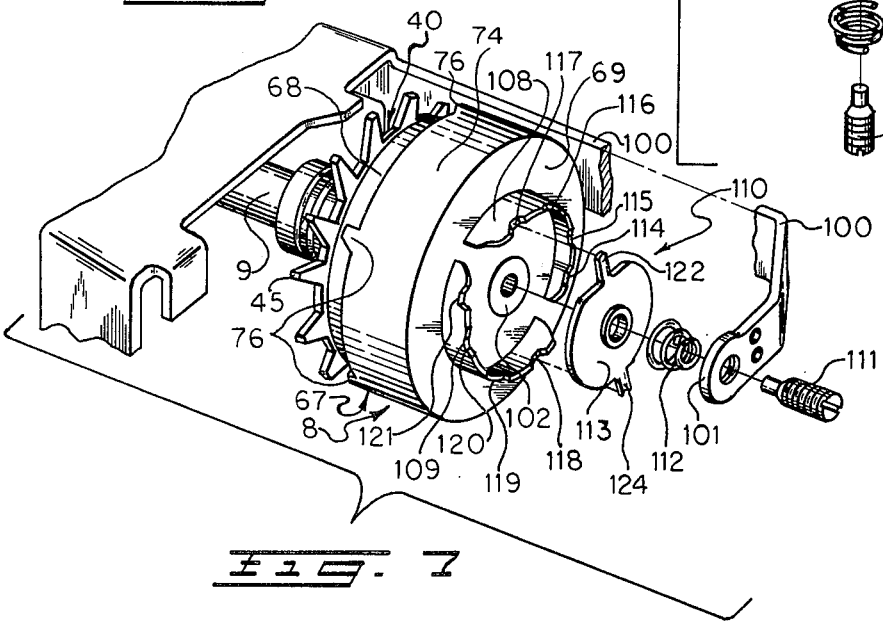
FIG. 7 is a perspective view of a portion of the invention when assembled and another portion exploded.

The inventive concept includes a centrifugal governor 8 that is co-axially supported on escapement shaft 9 that is clearly shown in FIGS. 1, 6, and 7. Cover 8 includes an open ended cylindrical housing 67 that defines a retaining chamber for a pair of floating flyweight segments 68 and 70.

Escapement shaft 9 is journaled within a frame 100 in a substantially vertical orientation and includes escapement wheel 40 fixed at a point distant from a lower end 102 with an integral pinion 104 at the upper end thereof. Escapement wheel 40 includes an integral drive pin 86 that projects downward between ends 83 and 85 of segments 68 and 70 for cooperation therewith. In the disclosed embodiment, a surface 89 of end 85 is substantially perpendicular to housing wall 71. Although a perpendicular relationship has been selected for the disclosed embodiments, it is to be understood that the angular relationship of surface 89 with wall 71 may be varied to vary the governor's efficiency.

Housing 67 includes a base 72 having a peripheral wall 74 extending therefrom. Disposed along the top edge of wall 74 are a plurality of spaced teeth 76. Centrally disposed on base 72 is a hub 78 having an aperture 80 through which shaft 9 projects when the housing is rotatably assembled thereon. Flyweight segments 68 and 70 are substantially semi-circular in contour and are floatably disposed within the confines of housing 67. The thickness of flyweight segments 68 and 70 is greater than the height of housing wall 74 and extend upwardly beyond housing wall 74. Therefore, the thickness of flyweight segments 68 and 70, being greater than the height of wall 74 will maintain the spaced relationship between housing teeth 76 and escapement wheel teeth 45 at all times.

Figure 4:
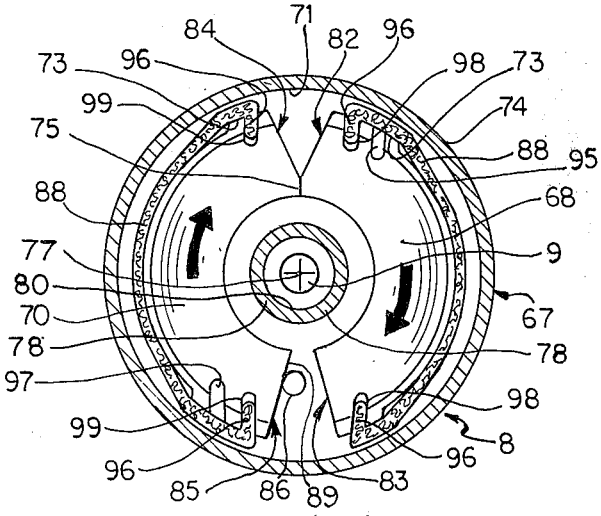
FIG. 4 is a bottom sectional view of a first embodiment of the invention with the housing bottom removed.

A first embodiment as illustrated in FIGS. 4 and 6 includes flyweight segments 68 and 70. Flyweight segments are semi-circular segmented discs having an inner circular cut out somewhat larger than the hub 78 of housing 67. Flyweight segments 68 and 70 are arcuate in contour having an outer peripheral surface 73 corresponding to the inner peripheral wall 71 of housing 67 for co-action therewith. A portion of the outer peripheral surface 73 of flyweight segments 68 and 70 intermediate ends 82, 83, 84 and 85 is relieved to accommodate the thickness of a pair of liners 88 whereby only the unrelieved surface 73 that have liners 88 disposed thereon functionally contact the inner peripheral wall 71 of housing 67. Disposed along the outer periphery of segments 68 and 70 proximate the ends thereof, are a plurality of slots 95, 97, 98, and 99 to provide attaching means for liners 88 that are attached near the lower surfaces 90 and 92 of flyweight segments 68 and 70.

The braking effect of segments 68 and 70 may be varied by altering the attaching location of liners 88. For example, the greater the surface contact of felt lined segments 68 and 70 with housing wall 71, the greater the braking effect of the governor as shown in FIG. 4. Consequently, if the ends of felt liners 88 were inserted into slots 95 and 97 instead of 98 and 99, as shown in FIG. 4, the surface contact of the felt liners with housing surface 71 would be reduced and the braking effect of the segments would likewise be reduced. In other words, the braking effect of the governor 8 is directly proportional to the positioning of the surface contact of segments 68 and 70 with the housing wall 71.

Segments 68 and 70 include abutting ends 82 and 84 that diverge from their contact point 75 of the load transfer projections. The disposition of loan transfer projection directly affects the braking efficiency of the segments and more importantly of the governor 8. During governor operation, the load transfer projection transfers the load exerted by drive pin 86 upon the end of segment 70 to the end of segment 68. Segment 70 is forced outward and wedged against wall 71 as it is urged to rotate by drive pin 86. Pin 86 via segment 70 and the load transfer projections force segment 68 to rotate and simultaneously force segment 68 outward against wall 71 of housing 67 which, at this time, has been rendered stationary. Therefore, the initial displacement of segments 68 and 70 against wall 71 by drive pin 86 hastens the response of governor 8 to tabulation movement of carriage 14. This is accomplished by the fact that segments 68 and 70 are physically forced against wall 71 by pin 86 before the segments have reached the velocity at which centrifugal forces take effect.

Changing the location of contact point 75 of the load transfer projections in relation to governor center 77, alters the braking response of governor 8. For example, the closer that contact point 75 of the load transfer projections is to center 77, the greater the outward wedging force exerted upon segment 68 by segment 70 and consequently, the quicker the braking response. The further from center 77 that contact point 75 of the load transfer projections, the less the wedging force exerted upon segment 68 by segment 70 and consequently, the slower the braking response.

Figure 5:
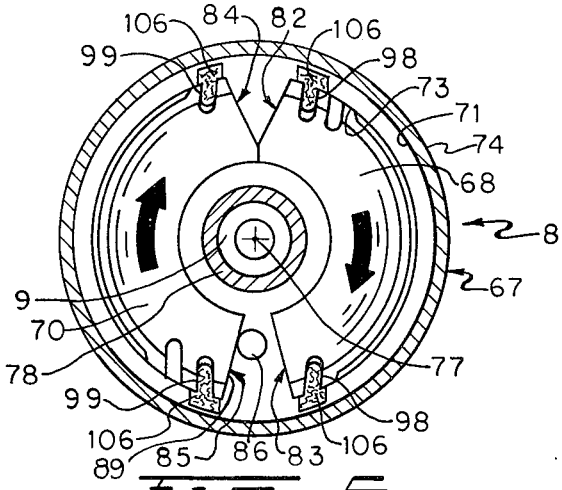
FIG. 5 is a bottom sectional view of a second embodiment of the invention with the housing bottom removed.

A second embodiment that is clearly shown in FIG. 5 includes a plurality of spaced felt inserts 106. Inserts 106 are disposed near the ends of flyweight segments 68 and 70 and functionally contact the inner peripheral wall 71 when escapement wheel 40 is rotating.

Figure 8:
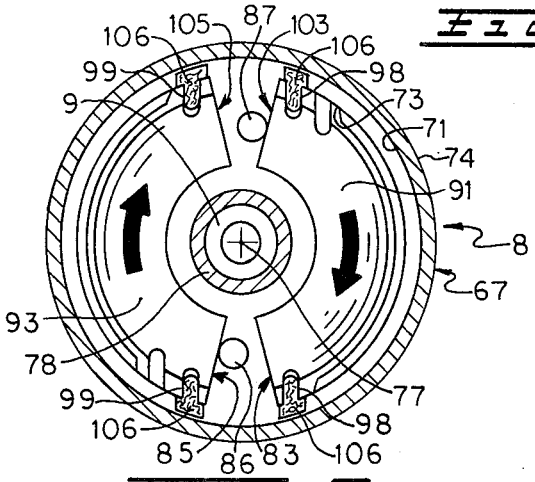
FIG. 8 is a bottom sectional view of the third embodiment of the invention with the housing bottom removed.

A third embodiment of the instant invention that is clearly shown in FIG. 8 illustrates the governor embodiment of FIG. 5 except for the following modification. A pair of segments 91 and 93 are disposed within housing 67. The segments are identical to segments 68 and 70 of the previous embodiments except that its ends 103 and 105 are formed without load transfer projections and do not contact one another at any time. A second drive pin 87 projects downward from escapement wheel 40 and is disposed between ends 103 and 105 of segments 91 and 93 for cooperation therewith.

During governor operation, pins 86 and 87 abut the ends of segments 68 and 70 to force both segments to rotate simultaneously and independently of one another whereby they are forced outward against wall 71 of stationary housing 67. The second drive pin is utilized in this embodiment in place of the load transfer projections of the first and second embodiments.

Figure 2:
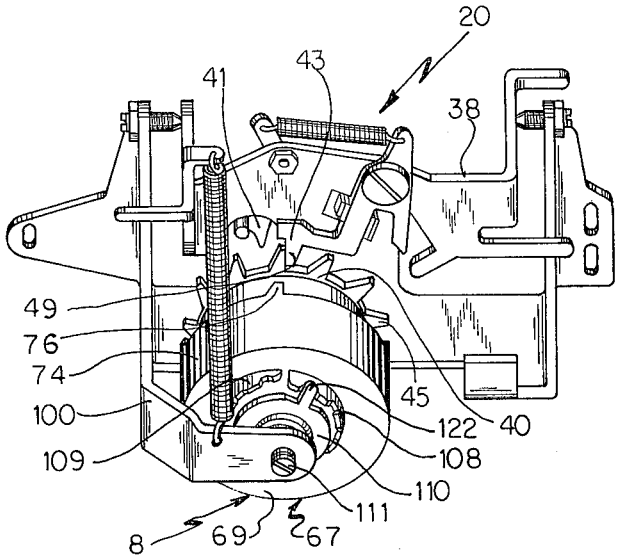
FIG. 2 is a rear perspective view of the escapement mechanism and the governor with the escapement mechanism oriented in rest position.

Actuation of speed retarding governor 8 is accomplished by initiating a tabulation operation. During typewriter operation, escapement rocker 38 is at rest as illustrated in FIGS. 1 and 2. In other words, escapement rocker 38 carries a ratchet dog 43 that includes a tooth 49 extending therefrom into the path of a tooth 45 of rotating escapement wheel 40. Escapement wheel 40, being coupled to carriage 14 through escapement shaft 9 and pinion 104, is urged to rotate when spring biased carriage 14 is urged to traverse but is prevented from doing so by engaged ratchet dog tooth 49.

When tabulation bar 22 is depressed and held in the depressed state, escapement rocker 38 is urged to pivot downward as shown in FIG. 3. At this time, escapement ratchet tooth 49 is displaced from its engagement with escapement wheel tooth 45 and is placed in the rotative path of governor housing tooth 76 thereby rendering governor housing 67 stationary. When escapement ratchet tooth 49 is disengaged from escapement wheel tooth 45, escapement wheel 40 is free to rotate and carriage 14, being coupled to escapement wheel 40, can now traverse at an ever increasing speed under the influence of spring 18 until pre-set tabulator stop 34 engages tabulator dog 31.

It is now that the speed retarding governor of the instant invention as taught in the first two embodiments, becomes operational. For example, drive pin 86, connected to rotating wheel 40, abuts segment end 85 of flyweight segment 70 and urges flyweight segment 70 to move outward to wedge against housing wall 71, and rotate. The simultaneous wedging and rotating of segments 68 and 70 minimizes the braking response time and increases the braking effect of the governor. Governor housing 67 starts to rotate with freed escapement wheel 40 but a projecting tooth 76 of housing wall 74 engages stationary escapement ratchet tooth 49 which holds housing 67 stationary. As flyweight segment 70 rotates clockwise, end 84 of flyweight segment 70 abuts end 82 of flyweight segment 68 and urges flyweight segment 68 to rotate. As the speed of escapement wheel 40 increases and the resulting centrifugal forces built up cause flyweights 68 and 70 to be forced against the stationary internal peripheral surface 71 of governor wall 74. The frictional contact of the felt lined rotating flyweight segments 68 and 70 with stationary surface 71 causes a speed limiting drag on escapement wheel 40, shaft 9, pinion 104 and carriage 14. The speed limiting drag is increased as the speed of traversing carriage 14 increases, thereby effecting a controlled carriage traverse during a tabulation operation and minimizing the possibility of damage to the typewriter.

When carriage 14 reaches the end of its movement, which is when tabulator stop 34 abuts tabulator dog 31, the rotational movement of escapement wheel 40 stops. Tabulator bar 22 is then released thereby allowing escapement rocker 38 to return to rest and the speed retarding governor returns to its ineffective position. The ineffective position of the governor is attained when there ceases to be any centrifugal force effect on flyweight segments 68 and 70. This occurs when rocker 38 returns to rest and housing 67 is freed from its engagement with ratchet tooth 49. Therefore, flyweight segments 68 and 70 are no longer driven by drive pin 86 and there is no further speed limiting drag on carraige 14.

The third embodiment of the instant invention, although structurally and functionally different than the previous embodiments, accomplish the same desired results. For example, pin 87 of the third embodiment instead of the load transfer projections as taught in the previous embodiments, urges segment 91 to rotate.

An adjustment is provided whereby the frictional contact between a hub face 79 of stationary governor housing 67 and rotating escapement wheel 40 may be increased or decreased, thereby increasing or decreasing the speed limiting capabilities of the governor. This adjustment is provided by the cooperation of a pair of centrally disposed cam walls 108 and 109 that project from the bottom surface 69 of governor housing 67 and an adjusting plate 110 under the urge of compression spring 112, best shown in FIGS. 6 and 7.

Adjusting plate 110 is rotatably supported about escapement shaft 9 and includes a flat central portion 113 having an integral flat lug 122 and an integral flat lug 124 extending in opposite directions therefrom.

Spring 112 is disposed in a compressed state between a flange 101 of frame 100 and adjusting plate 110. Spring 112 is oriented axially between flange 101 and adjusting plate 110 by escapement shaft 9 and an alignment stud 111.

Defining the upper edge of cam wall 108 are a plurality of cam surfaces 114, 115, 116 and 117 of different heights. Defining the upper edge of cam wall 109 are a plurality of cam surfaces 118, 119, 120, and 121 also of different heights but equivalent to the heights of opposite cam surfaces on cam wall 108.

Adjusting plate lugs 122 and 124 are spring biased into engagement with cam surfaces 114 and 121 of cam wall 108 and 109 respectively. The height of cam surface 114 is the same as the height of cam surface 121. Therefore when lugs 122 and 124 engage cam surfaces 114 and 121, adjusting plate 110 is oriented in a plane parallel with governor housing surface 69. The height relationship of cam surface 115 to 120, 116 to 119, and 117 to 118 is the same as the foregoing height relationship of cam surface 114 and 121. As a result, adjusting plate 110 will always be oriented in a plane parallel to governor housing surface 69.

When it is desired to vary the pressure of the housing hub face 79 against escapement wheel 40, adjusting plate 110 is rotated. As adjusting plate 110 is rotatably adjusted, lugs 122 and 124 are relocated to different opposite cam surfaces in walls 108 and 109. If the height of the new cam surface is greater than the previously engaged cam surface, the pressure of stationary governor housing hub face 79 against the surface of rotating escapement wheel 40 will be increased to supplement the speed limiting drag of flyweight segments 68 and 70. If the height of the new cam surfaces is less than the previously engaged cam surfaces, the pressure of stationary governor housing hub face 79 against the surface of rotating escapement wheel 40 will be decreased to lessen the supplemented speed limiting drag of flyweight segments 68 and 70.

It can be seen from the foregoing description that the present invention provides a typewriter governor of simplified structure and compact construction including floatably disposed lightweight flyweight segments that are self seating and self aligning which require no critical adjustment for smooth and efficient operation and positive means for effecting rotational movement of the flyweight segments.

While the invention has been particularly shown and described with reference to the described embodiments thereof, it will be understood by those skilled in the art that the foregoing, and other changes in form and details may be made therein without departing from the scope of the invention.

What is claimed is:

1. A carriage retarding governor for typewriters that includes a traversable carriage, the movement of which is regulated by an escapement mechanism that includes a rotatable toothed escapement drive wheel that is coupled to a carriage rack by an integral shaft and pinion gear, the carriage retarding governor comprising:

a rotatable housing having an arcuate wall;

a pivotless segment disposed within said housing;

means on said housing for selectively rendering said housing stationary; and means for engaging and urging said segment to rotate under the influence of the movement of the carriage and be centrifugally displaced and wedged against said stationary housing thereby retarding the traverse of the carriage.

2. A carriage retarding governor as defined in claim 1 wherein the outer periphery of said segment is arcuate and having its end portions complimentary with the inner surface of said wall of said housing when said segment is rotating.

3. A carriage retarding governor as defined in claim 2 wherein the periphery of said segment is lined with resilient material for providing a quieter and smoother cooperation with said housing wall.

4. A carriage retarding governor as defined in claim 1 wherein said segment is floatably disposed within said housing for free movement relative to said housing when said segment is urged to rotate.

5. A carriage retarding governor as defined in claim 1 wherein said engaging means is a rigid pin on the drive wheel that projects into the path of said segment for abutting an end of said segment to urge said segment to rotate when the carriage is traversing.

6. A carriage retarding governor as defined in claim 5 wherein said housing includes a plurality of teeth disposed on said housing engageable by a tooth of the escapement rocker of the escapement mechanism for rendering said housing stationary.

7. A carriage retarding governor as defined in claim 1 wherein said housing includes means for adjusting the contact between said toothed drive wheel and said housing.

8. A carriage retarding governor as defined in claim 7 wherein said adjusting means includes a plurality of cam surfaces disposed on said housing and an adjusting plate co-axially supported with said housing for engaging said plurality of cam surfaces.

9. A carriage retarding governor as defined in claim 8 wherein said adjusting plate includes a pair of engaging lugs that are biased towards said cam surfaces for engagement therewith.

10. A carriage retarding governor as defined in claim 8 wherein said plurality of cam surfaces project from said housing at different heights for providing different adjustment levels. between said toothed drive wheel and said housing.

11. A carriage retarding governor for typewriters that includes a traversable carriage, the movement of which is regulated by an escapement mechanism that includes a rotatable toothed drive wheel that is coupled to a carriage rack by an integral shaft and pinion gear, the carriage retarding governor comprising;

a rotatable housing having an arcuate wall;

a pair of pivotless segments disposed within said housing;

means on said housing for selectively rendering said housing stationary; and means on the toothed drive wheel for engaging and urging said segments to rotate under the influence of the movement of the carriage and be centrifugally displaced and wedged against said stationary housing thereby retarding the traverse of the carriage.

12. A carriage retarding governor as defined in claim 11 wherein the outer periphery of said segments is arcuate and having their end portions complimentary with the inner surface of said wall of said housing when said segments are rotating.

13. A carriage retarding governor as defined in claim 12 wherein the periphery of said segments is lined with resilient material for providing a quieter and smoother cooperation with said housing wall.

14. A carriage retarding governor as defined in claim 11 wherein said segments are floatably disposed within said housing for free movement relative to said housing when said segments are urged to rotate.

15. A carriage retarding governor as defined in claim 11 wherein said engaging means includes a rigid pin on the drive wheel that projects into the path of one of the said segments for abutting an end of said segment to urge said segment to rotate when the carriage is traversing.

16. A carriage retarding governor as defined in claim 15 wherein said housing means includes a plurality of teeth disposed on said housing engageable by a tooth of the escapement rocker of the escapement mechanism for rendering said housing stationary.

17. A carriage retarding governor as defined in claim 16 wherein said housing means further includes means for adjusting the contact between said toothed wheel and said housing.

18. A carriage retarding governor as defined in claim 17 wherein said adjusting means includes a plurality of cam surfaces disposed on said housing and an adjusting plate co-axially supported with said housing for engaging said plurality of cam surfaces.

19. A carriage retarding governor as defined in claim 18 wherein said adjusting plate includes a pair of engaging lugs that are biased toward said cam surfaces for engagement therewith.

20. A carriage retarding governor as defined in claim 18 wherein said plurality of cam surfaces project from said housing and are at different heights for providing different adjustment levels between said toothed drive wheel and said housing.

21. A carriage retarding governor as defined in claim 15 wherein said engaging means further includes a second rigid pin on the drive wheel that projects into the path of another of said segments for abutting an end of said segment to urge said segment to rotate with said other segment when the carriage is traversing.

22. A carriage retarding governor as defined in claim 15 wherein said housing means includes a plurality of teeth disposed on said housing engageable by a tooth of the escapement rocker of the escapement mechanism for rendering said housing stationary.

23. A carriage retarding governor as defined in claim 22 wherein said housing means further includes means for adjusting the contact between said toothed drive wheel and said housing.

24. A carriage retarding governor as defined in claim 23 wherein said adjusting means includes a plurality of cam surfaces disposed on said housing and an adjusting plate co-axially supported with said housing for engaging said plurality of cam surfaces.

25. A carriage retarding governor as defined in claim 24 wherein said adjusting plate includes a pair of engaging lugs that are biased towards said cam surfaces for engagement therewith.

26. A carriage retarding governor as defined in claim 25 wherein said plurality of cam surfaces project from said housing and are at different heights for providing different adjustment levels between said toothed drive wheel and said housing.

27. A carriage retarding governor for typewriters that includes a traversable carriage, the movement of which is incrementally regulated by an escapement mechanism that includes a rotatable toothed drive wheel that is coupled to a carriage rack by an integral shaft and pinion gear, the carriage retarding governor comprising in combination:

a rotatable cylindrical housing;

a pivotless arcuate segment freely disposed within said housing;

a plurality of teeth on said housing selectively engageable by the escapement mechanism for rendering said housing stationary; and;

a rigid stud on the rotatable drive wheel for engaging and urging said segment to rotate under the influence of the movement of the carriage and be centrifugally displaced and wedged against said stationary housing thereby retarding the traverse of the carriage.

28. A carriage retarding governor for typewriters that includes a traversable carriage, the movement of which is incrementally regulated by an escapement mechanism that includes a rotatable toothed drive wheel that is coupled to a carriage rack by an integral shaft and pinion gear, the carriage retarding governor comprising in combination:

a rotatable cylindrical housing;

a pair of arcuate segments freely disposed within said housing;

a plurality of teeth of said housing selectively engageable by the escapement mechanism for rendering said housing stationary; and;

a rigid stud on the rotatable drive wheel for engaging and urging said segments to rotate under the influence of the movement of the carriage and be centrifugally displaced and wedged against said stationary housing thereby retarding the traverse of the carriage.

29. A carriage retarding governor for typewriters that includes a traversable carriage, the movement of which is regulated by an escapement mechanism that includes a rotatable toothed drive wheel that is coupled to a carriage rack by an integral shaft and pinion gear, the carriage retarding governor comprising:

a rotatable housing having an arcuate wall;

a pair of arcuate segments freely disposed within said housing;

means on said housing for selectively rendering said housing stationary;

a rigid pin on the toothed drive wheel for engaging ends of said segments for urging said segments to rotate under the influence of the movement of the carriage and be wedged against said stationary housing to initially retard the traverse of the carriage and thereafter be centrifugally displaced against said stationary housing to further retard the carriage traverse; and varying means on said arcuate segments to provide a wedging force of said segments against said stationary housing.

30. A carriage retarding governor as defined in claim 29 wherein said varying means is disposed at the ends of said segments.

31. A carriage retarding governor as defined in claim 30 wherein said ends of said segments are angled relative to said housing for increasing the wedging force of said segments against said stationary housing in response to engagement by said rigid pin.

32. A carriage retarding governor for typewriters that includes a traversable carriage, the movement of which is regulated by an escapement mechanism that includes a rotatable toothed drive wheel that is coupled to a carriage rack by an integral shaft and pinion gear, the carriage retarding governor comprising:

a rotatable housing having an arcuate wall;

a pivotless segment disposed within said housing;

means on said housing for selectively rendering said housing stationary;

means for engaging and urging said segment to rotate under the influence of the movement of the cartridge and be centrifugally displaced and wedged against said stationary housing thereby retarding the traverse of the carriage; and means on said segment for limiting the peripheral contact of the ends of said segment against said housing wall to provide an initial braking.

33. A carriage retarding governor as defined in claim 32 wherein said limiting means includes a pair of spaced pads.

34. A carriage retarding governor as defined in claim 33 wherein said pads are made of resilient material.

* * * * *